United States Patent [19]

Hendrix et al.

[11] Patent Number: 4,507,350

[45] Date of Patent: Mar. 26, 1985

[54] METHOD OF PRODUCING OPAQUE PRINTED TEXTILE FABRICS WITH CURING BY FREE RADICAL INITIATION AND RESULTING PRINTED FABRICS

[75] Inventors: James E. Hendrix, Spartanburg, S.C.; John Y. Daniels, Pineville, N.C.

[73] Assignee: Springs Industries, Inc., Fort Mill, S.C.

[21] Appl. No.: 587,397

[22] Filed: Mar. 8, 1984

[51] Int. Cl.[3] ..... B32B 3/00

[52] U.S. Cl. ..... 428/196; 8/495; 427/282; 427/288; 427/389.9; 428/206; 428/207; 428/240; 428/283; 428/323

[58] Field of Search ..... 428/196, 206, 207, 225, 428/240, 323; 427/282, 288, 389.9; 8/495

[56] References Cited

U.S. PATENT DOCUMENTS

| | | | |
|---|---|---|---|
| 2,310,436 | 2/1943 | Johnson | 8/14 |
| 3,441,427 | 4/1969 | Skofroneck | 427/288 |
| 3,443,979 | 5/1969 | Skofroneck | 427/288 |
| 3,948,597 | 4/1976 | Sakoaka | 8/14 |
| 4,031,280 | 6/1977 | Weller et al. | 428/196 |
| 4,280,888 | 7/1981 | Buch et al. | 428/207 |
| 4,283,452 | 8/1981 | Marco | 428/206 |
| 4,315,790 | 2/1982 | Rattie et al. | 428/207 |
| 4,351,871 | 9/1982 | Lewis et al. | 428/196 |

FOREIGN PATENT DOCUMENTS

| | | |
|---|---|---|
| 1107636 | 5/1961 | Fed. Rep. of Germany . |
| 1444060 | 12/1968 | Fed. Rep. of Germany . |
| 1593299 | 7/1970 | France . |
| 2402733 | 4/1979 | France . |
| 589782 | 6/1947 | United Kingdom . |
| 926283 | 5/1963 | United Kingdom . |
| 929451 | 6/1963 | United Kingdom . |
| 954587 | 4/1964 | United Kingdom . |
| 954588 | 4/1964 | United Kingdom . |
| 954589 | 4/1964 | United Kingdom . |
| 1433609 | 4/1976 | United Kingdom . |
| 1514504 | 6/1978 | United Kingdom . |

*Primary Examiner*—James J. Bell

*Attorney, Agent, or Firm*—Bell, Seltzer, Park & Gibson

[57] ABSTRACT

Highly opaque printed areas are produced on uncolored or precolored fabrics pursuant to this invention with the use of an aqueous opaque printing paste comprising a dispersion of an opacifying pigment and an aqueous binder which is cured by free radical initiation. In accordance with the invention multicolor prints with a variety of unique and visually appealing shade possibilities and color effects not heretofore possible are achieved.

16 Claims, 1 Drawing Figure

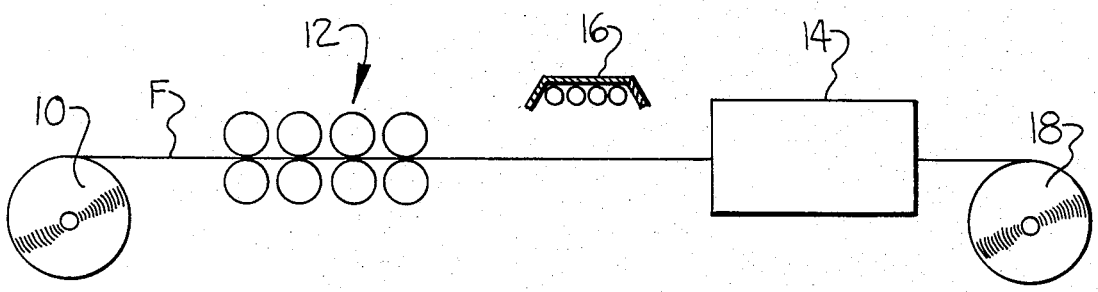
12
16
14
10
F
18

METHOD OF PRODUCING OPAQUE PRINTED TEXTILE FABRICS WITH CURING BY FREE RADICAL INITIATION AND RESULTING PRINTED FABRICS

CROSS REFERENCE TO RELATED APPLICATIONS

This application is related to commonly-owned copending applications Ser. No. 429,794 filed Sept. 30, 1982, entitled TEXTILE FABRICS WITH OPAQUE PIGMENT PRINTING AND METHOD OF PRODUCING SAME, now U.S. Pat. No. 4,457,980 issued July 3, 1984; and application Ser. No. 435,949 filed Oct. 22, 1982, entitled COLORED OPAQUE PRINTING OF TEXTILE FABRICS USING DYE STUFFS, now U.S. Pat. No. 4,438,169, issued Mar. 20, 1984.

FIELD AND BACKGROUND OF THE INVENTION

This invention relates to textile pigment printing, and in particular to the production of a printed textile fabric wherein the printed areas are of a predetermined desired color and are characterized by being substantially opaque and thus unaffected by the color of the underlying yarns. This invention is related to and is an improvement over the invention described in the above referenced commonly-owned copending applications.

These earlier applications disclose a unique new type of textile printing process and product in which the printed areas on the textile fabric are substantially opaque and are thus unaffected by the color of the underlying yarns. The aqueous opaque printing process and product of these earlier applications overcome a number of significant limitations and disadvantages of conventional pigment printing techniques and enable the production of a wide variety of patterns and colors not obtainable by the pigment printing techniques heretofore known. The printing paste which is used in the opaque printing process, unlike the aqueous printing pastes used in conventional screen printing operations, has opacity and can be applied over either dark or light background fabrics without being affected by the color of the underlying yarns. The resulting printed pattern areas on the fabric comprise an opaque coating which covers the exposed surfaces of the yarns which form the fabric. This coating comprises an opacifying pigment providing opacity in the coating and a cured water insoluble polymer binder which is affixed to the yarns and bonds the opacifying pigment to the yarns. The opaque coating which forms the printed pattern areas is characterized by individually coating each of the yarns in the printed area such that the interengaged yarn structure of the fabric is not obliterated, but remains visible. More specifically, the opaque coating at the surface of the yarn is such that the individual surface fibers of the yarn also are not obliterated and remain visible.

The opaque coating which forms the printed pattern areas may be of any desired color. For relatively light colors, such as white, the opacifying pigment itself may be utilized for providing the desired colors. Other colors may be produced by including colored pigments or dyestuffs in the printing paste in addition to the opacifying pigment.

The printing paste is applied to the fabric as a stable aqueous dispersion of the opacifying pigment and polymer binder. After printing on the fabric, the printing paste is dried and cured by heating, with a crosslinking reaction taking place, such that the polymer binder is converted from the aqueous solution or dispersion as it is applied to a tough flexible water insoluble pigmented opaque film. More particularly, the printing paste formulations described in the aforementioned applications rely on acrylic latex and/or aminoplast resins for crosslinking during curing.

SUMMARY OF THE INVENTION

The present invention provides an alternative procedure for producing cured aqueous opaque textile prints which offer a number of advantages over the abovedescribed system of the commonly-owned copending applications referred to earlier. In producing opaque printed areas on textile fabrics in accordance with the present invention, a printing paste is utilized which contains the opacifying pigment and a binder which is comprised of monomeric, oligomeric and/or polymeric units capable of being polymerized and cured by free radical initiation. After application of the printing paste to the fabric, the fabric is subjected to free radical initiation to polymerize and cure the binder and thereby bond the opacifying pigment to the yarns.

In accordance with one aspect of the invention, the polymerizable binder is a radiation curable binder, and the fabric is subjected to free radical initiation by irradiating the fabric with high energy radiation.

In another embodiment of the invention, the polymerizable binder additionally contains a free radical initiator, which may be activated by suitable means such as heating or exposure to radition; and by activating the initiation, the fabric is subjected to free radical initiation to thereby polymerize and cure the binder.

An advantage of the free radical curing procedure of the present invention is that the printing paste does not require the presence of a catalyst, which sometimes causes yellowing or discoloration of the fabric under curing conditions. Atmospheric pollutants, associated with solvent systems such as in conventional opaque stencil printing are also eliminated. Additionally, this procedure in many instances makes it possible to carry out curing at a lower temperature, which has many advantages, such as energy savings, reducing fabric shrinkage, and permitting the curing to be carried out at a faster rate.

BRIEF DESCRIPTION OF THE DRAWINGS

Some of the features and advantages of the invention having been stated, others will become apparent from the detailed description and examples which follow, and from the accompanying drawing, which is a schematic illustration of an arrangement of apparatus suitable of carrying out the process of this invention.

DETAILED DESCRIPTION

The aqueous opaque colored printing paste of the present invention has a relatively high solids content, e.g. preferably at least 25 percent total solids, and consists mainly of an opacifying pigment and a free radical polymerizable binder mixed therewith to form a stable aqueous dispersion.

To serve as an opacifying pigment for purposes of this invention, the material must be highly opaque, have color properties which permit it to be used alone or mixed with other colorants, such as dyes and colored pigments, and it must be readily dispersable at relatively high concentrations in the aqueous binder system. There are many commercially available materials having these characteristics. Where it is desired to provide a relatively light colored printed area, particularly against a relatively darker background color, the preferred opacifying pigment for use in the printing paste formulation of this invention is a white pigment. One particular white pigment which has been found to be especially suitable because of its bright white appearance, cost and availability is titanium dioxide. Other suitable white pigments include silicates, aluminum compounds, calcium carbonate, and the like. In order to achieve high chroma (color saturation) with certain hues, one or more opacifying pigments of lesser whiteness or of intermediate shades may be employed, either alone or in combination with white pigments.

In addition to the white opacifying pigments noted above, examples of other compounds suitable for use as opacifying pigments in the present invention include the following: zinc oxide, zinc sulfide, lithopone ($ZnS/BaSO_4$), basic carbonate white lead, basic sulfate white lead, lead oxide (lead dioxide), calcium sulfate, barium sulfate, silica, clay ($Al_2O_3.2SiO_2.2H_2O$), lead sulfate, magnesium silicate, mica, wollastonite ($CaSiO_3$), aluminum hydrate, magnesium oxide, magnesium carbonate, aluminum oxide, ferric oxide, sodium carbonate, strontium sulfide, calcium sulfide, barium carbonate, antimonius oxide, zirconium white, barium tungstate, bismuth oxychloride, tin white, lead silicate, chalk, bentonite, barium sulfate, gloss white, gypsum, zinc phosphate, lead phosphate, and calcium silicate. For the printing of relatively dark colors, carbon black may be used as an opacifying pigment instead of a lighter colored pigment.

The use of an opacifying pigment, particularly a white opacifying pigment, and the printing thereof against a darker background color, are features which clearly distinguish the opaque pigment printing of this invention over conventional non-opaque pigment printing techniques. In conventional pigment printing, white pigments are used only on a white or light shade background fabric for achieving a "white-on-light" effect. Conventional pastel or white pigment printing pastes are not generally applied to darker background colors, since such printing pastes would not provide adequate uniform opacity against the darker background color.

The amount of the opacifying pigmet used in the printing paste formulation of this invention is considerably greater than the amount of pigment used in conventional aqueous-based non-opaque printing pastes, and is typically considerably greater than the total solids content of the polymer binder. In a preferred formulation, the printing paste comprises at least 20 weight percent opacifying pigment (solids basis) and at least 5 weight percent polymer binder (solids basis).

The binder for the opacifying pigment must be capable of application in an aqueous system, form a stable dispersion with the insoluble opacifying pigments and other additives in the binder system, have good film-forming properties when applied to the fabric, and must be capable of being dried and cured to a water insoluble state imparting good washfastness and abrasion resistance properties to the printed pattern. The polymer binder may be suitably applied as an aqueous solution or dispersion. The print paste may be thereafter dried to a desired degree by suitable means, such as by heating, and cured via free radical curing as described more fully herein.

The mechanism involved in free radical curing of the printing paste in accordance with the present invention is significantly different from that in conventional thermal curing. In the latter, strong catalysts, such as p-toluenesulfonic acid may be employed with cross-linking agents which cure when the printing paste is subjected to elevated temperatures. Free radical curing relies upon the presence of free radicals for the initiation of a free radical addition polymerization reaction. Thus, in order to achieve the curing, selected monomers, oligomers, polymers, or mixtures of these are included in the print paste which contain functional groups which are susceptible to free radical addition polymerization.

Generation of the free radicals needed to initiate the polymerization reaction may be accomplished in a number of different ways. Certain compounds, such as styrene for example, will polymerize by free radical polymerization with application of heat alone. Other compounds require free radical initiators to provide the free radicals necessary for the free radical polymerization reaction to take place. The free radical initiators may be in the form of chemical compounds which will generate free radicals upon being subjected to certain influences, such as heating or radiation. Examples of chemical compounds which may be used as initiators to generate free radicals with heating include, but are not limited to, benzoyl peroxide, acetyl peroxide, azodiisobutyronitrile, t-butylhydroperoxide, cumene hydroperoxide, t-butylperoctoate, di-t-butyl peroxide, succinyl peroxide, dicermyl peroxide, dichlorobenzoylperoxide, azodicyclohexylcarbonitrile, and ethoxyethoxyethyl acrylate. Examples of monomers, oligomers and/or polymers that are capable of curing through free radical addition polymerization include, vinyl monomers, substituted ethylenes, conjugated dienes, non-conjugated dienes, polysiloxanes, N-vinyl-2-pyrrolidone, 2-methyl butadiene, vinylnaphthalene, glycol dimethacrylate, vinylacetate, acrylamide, methyl acrylate, methyl methacrylate, pentaerythritol acrylate, vinyltriethoxy silane, vinyl functional polydimethylsiloxane, curable urethane monomers, etc.

As an alternative to the use of chemical free radical initiators, it is possible to initiate free radical polymerization by irradiation with actinic radiation. The most well known methods of radiation curing are electron beam (EB) curing and ultraviolet light (UV) curing. Typically, UV curing requires the inclusion of a photoinitiator for free radical generation. EB curing, on the other hand, relies on the generation of free radicals via the transfer of kinetic energy from the accelerated electron to the polymer. There are a wide range of monomers, oligomers and polymers which are suitable for high energy irradiation curing. These include, but are not limited to, acrylate and methacrylate monomers and oligomers such as acrylated epoxies, urethanes, polyesters and acrylics, multifunctional monomers, maleates, vinyl compounds such as vinylethyl ethers, linear polyesters, and maleates or itaconates of mono or polyhydric alcohol, and N-vinyl-2-pyrrolidone.

In addition to the opacifying pigment and free radical curable binder, the printing paste may optionally include colorants, such as colored pigments or dyes, for providing the desired color to the printing paste.

The dyes which may be suitably employed for coloring the binder may comprise at least one member selected from the group consisting of acid dyes, cationic dyes, direct dyes, disperse dyes, fiber reactive dyes, mordant dyes, and solvent dyes. Azoic dyes, vat dyes, and sulfur dyes may also be used; however, the azoic compounds, vat dyes and unreduced sulfur dyes would in effect behave as pigments since in the unreduced form they are insoluble.

Silicone fluids and elastomers may be incorporated into the printing paste to aid in obtaining a smooth application of the pigment to the fabric. The use of silicone polymers has been found to provide dots or designs free of rough edges and crack marks.

Conventional thickeners may also be utilized to control the viscosity and rheology of the paste, depending upon the size and design of the print pattern and the running speed of the print screen.

The paste may also contain other conventional additives, such as emulsifiers, antifoam agents, and pH control agents. It is important that the printing paste have good wetting and film-forming properties so that when applied to the fabric, it will penetrate and coat the individual yarns of the fabric rather than remaining on the surface of the fabric. If these properties are not adequately presented by the polymer binder itself, suitable wetting agents or emulsifiers may be included.

The printing paste may be applied either to uncolored (e.g. white) fabrics or to precolored fabrics, the precolored fabrics being of a predetermined color throughout and produced by any suitable method such as by piece dyeing, yarn dyeing or by pigment padding, for example.

The particular rate of application of the printing paste to the fabric will vary depending upon various factors, including fabric weight and construction, color of the fabric, and printing color.

Drying and curing of the printing paste may be carried out under conditions of temperature and time suitable for the particular manner of application and curing mechanism employed. For rotary screen printing of a paste containing thermally activated chemical free radical initiators, for example, drying and curing may be carried out at temperatures of 250 to 425 degrees F. for from several seconds up to several minutes.

When the fabric is cured and dried, the areas printed with the printing paste are characterized by having a thin flexible opaque coating covering the exposed surfaces of the yarn and thus hiding from view the underlying color of the yarn. The coating consists predominantly of the opacifying pigment bonded securely to the yarns by the cured water insoluble polymer binder.

An arrangement of apparatus suitable for carrying out the process of the present invention is schematically illustrated in the drawing. As shown, a fabric F is advanced from a suitable supply source, such as roll 10 through a rotary printing range, generally indicated at 12 consisting of a series of rotary printing cylinders. Rotary textile printing ranges are well known in the art, and therefore a detailed description of its construction and operation is not warranted.

After leaving the printing range 12, the fabric is advanced through a heating zone 14 for drying the printing paste. The heating zone 14 may suitably comprise a heated tenter frame as is conventional in the art.

When curing a free radical curable binder containing thermally activatable free radical initiators, the heat provided in the heating zone 14 alone is sufficient for generating the free radicals necessary for polymerization and curing. As shown in the drawing, however, for radiation curable compositions, a radiation source 16, such as ultraviolet lamps or an electron curtain, may be located upstream from the heating zone for directing radiation onto the fabric for thereby initiating free radical generation and curing. Alternatively, the electron curtain 16 may be located downstream from the drying zone 14. After drying and curing of the printing paste has been been effected, the fabric F may be taken up on suitable means such as a roll 18 as illustrated.

Because of the excellent opacity of the aqueous opaque colored printing paste formulations of the present invention, which permits printing vivid contrasting colors on predyed fabrics of any desired color, and the fact that the printing paste formulations of this invention can be readily applied on conventional rotary screen printing equipment, the present invention makes it possible to produce a variety of colors and patterns not heretofore possible. Thus, one additional aspect of the present invention is the production of a printed textile fabric formed of precolored yarns, and in particular dyed yarns of a predetermined color, selected areas of the fabric having printed pattern areas of predetermined color contrasting with the color of the yarns, the printed pattern areas being substantially opaque and thus unaffected by the color of the yarns, and the pattern areas being formed of a plurality of colors contrasting with one another and with said predetermined color of the yarns, at least one of the colors being lighter than said predetermined color dyed yarns, and said pattern areas comprising a filmlike coating covering the exposed surfaces of the yarns, said coating comprising an opacifying pigment providing opacity in said coating and a free radical cured binder securely bonding said opacifying pigment to the yarns.

EXAMPLES 1 AND 2

The following examples illustrate opaque print paste formulations which use addition polymerization reactions initiated by chemically generated free radicals to promote curing.

| | Percent |
|---|---|
| Example 1 | |
| Pioneer White BS Pigment | 57 |
| Blockout B (aluminum silicate dispersion) | 13 |
| Urethane Oligomer (Uvithane 782) | 29 |
| Benzoyl Peroxide | 1 |
| Example 2 | |
| Pioneer White BS Pigment | 57 |
| Blockout B (aluminum silicate dispersion) | 13 |
| Urethane Oligomer (Uvithane 783) | 14 |
| V-Pyrol | 15 |
| Benzoyl Peroxide | 1 |

The print pastes are brought to a suitable viscosity with a conventional print paste thickener, depending on the type printing machine employed—rotary screen, flatbed, etc. The fabric is then printed and cured as normal at approximately 360° F. or thermosoled up to 425° F.

EXAMPLES 3 AND 4

The following examples illustrate opaque print paste formulations containing irradiation curable monomers.

| | Percent |
|---|---|
| Example 3 | |
| Pioneer White BS Pigment | 57 |
| Blockout B (aluminum silicate dispersion) | 13 |

-continued

| | Percent |
|---|---|
| Pentaerythritol Acrylate (Uvithane ZA-1192) | 28 |
| Photoinitiator (diethoxy-acetophenone) | 2 |
| Example 4 | |
| Pioneer White BS Pigment | 57 |
| Blockout B (aluminum silicate dispersion) | 13 |
| Ethoxyethoxyethyl Acrylate (Reactomer RC-20) | 28 |
| Photoinitiator (diethoxy-acetophenone) | 2 |

The viscosity of the print paste is adjusted to that necessary for the particular printing machine used, rotary screen, flatbed, etc. using a conventional printing thickener. After printing the fabric may either be dried in a conventional oven, then irradiated or simply irradiated immediately after printing, depending on the drying achievable during irradiation. Duration of irradiation depends on the type of irradiation equipment employed; U.V., electron beam, electron curtain, etc., and the intensity of the dose rate.

In the drawings and specification, there has been set forth a preferred embodiment of the invention, and although specific terms are employed, they are used in a generic and descriptive sense only and not for purposes of limitation.

That which is claimed is:

1. A process of producing a textile fabric having printed areas thereon which are substantially opaque and unaffected by the color of the underlying yarns, said process comprising applying to selected portions of the fabric an opaque coating of a printing paste covering the exposed surfaces of the yarns and hiding the underlying color thereof, said printing paste comprising an opacifying pigment and a polymerizable binder comprised of free radical polymerizable monomeric, oligomeric and/or polymeric units, and thereafter subjecting the fabric to free radical initiation to polymerize and cure the binder and thereby bond the opaque coating to the yarn.

2. The process according to claim 1 wherein said polymerizable binder comprises a radiation curable binder, and said step of subjecting the fabric to free radical initiation comprises irradiating the fabric with high energy radiation.

3. The process according to claim 1 wherein said polymerizable binder also comprises a heat activatible free radical initiator, and said step of subjecting the fabric to free radical initiation comprises heating the fabric to activate said free radical initiator.

4. The process according to claim 1 wherein the printing paste composition comprises a stable aqueous dispersion of the opacifying pigment and polymerizable binder.

5. The process according to claim 1 wherein the printing paste composition has a solid content of at least 30 percent by weight.

6. The process according to claim 1 wherein said step of applying the printing paste to the fabric comprises applying the printing paste to a precolored fabric.

7. The process according to claim 6 wherein the precolored fabric is of a relatively dark color and the printing paste is of a contrasting lighter color.

8. A process of producing a textile fabric having printed areas thereon which are substantially opaque and unaffected by the color of the underlying yarns, said process comprising applying to selected areas of the fabric a printing paste comprising a stable aqueous dispersion of an opacifying pigment and a radiation curable binder to form an opaque coating covering the exposed surfaces of the yarns of the fabric and hiding the underlying color thereof, drying the printing paste, and thereafter subjecting the fabric to high energy irradiation to polymerize and cure the binder and thereby bond the opaque coating to the yarns.

9. A process of producing a textile fabric having printed areas thereon which are substantially opaque and unaffected by the color of the underlying yarns, said process comprising applying to selected areas of the fabric a printing paste comprising a stable aqueous dispersion of an opacifying pigment, a polymerizable binder, and a heat activatible free-radical initiator, to form an opaque coating covering the exposed surfaces of the yarns of the fabric and hiding the underlying color thereof, and heating the fabric to dry the aqueous printing paste and to activate the free radical initiator to polymerize and cure the binder and thereby bond the opaque coating to the yarns.

10. A process of producing a textile fabric having printed areas thereon which are substantially opaque and unaffected by the color of the underlying yarns, said process comprising advancing the fabric along a predetermined path of travel and past a rotary printing station and applying to predetermined areas of the fabric an opaque printing paste comprising a stable aqueous dispersion of an opacifying pigment and a polymerizable binder comprised of free radical polymerizable monomeric, oligomeric and/or polymeric units, said coating covering the exposed surfaces of the yarns of the fabric and hiding the underlying color thereof, directing the printed fabric from said rotary printing station and subjecting the fabric to free-radical initiation to polymerize and cure the binder and thereby bond the opaque coating to the yarns.

11. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque coating covering the exposed surfaces of the interengaged yarns, said coating comprising an opacifying pigment providing opacity in said coating and a free radical polymerized binder bonding said opaque coating to the yarns.

12. A printed textile fabric according to claim 11 wherein said coating additionally includes colored pigments for providing a predetermined desired color to the printed pattern areas.

13. A printed textile fabric according to claim 11 wherein said coating additionally includes dyestuffs for providing a predetermined desired color to the printed pattern areas.

14. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque coating covering the exposed surfaces of the interengaged yarns, said coating comprising an opacifying pigment providing opacity in said coating and a radiation cured polymer binder bonding said opaque coating to the yarns.

15. A printed textile fabric according to claim 14 wherein said coating additionally includes a UV photo-initiator.

16. A printed textile fabric formed of interengaged yarns of a predetermined color, selected areas of said fabric having printed pattern areas of predetermined color contrasting with the color of said yarns, said printed pattern areas being substantially opaque and thus unaffected by the color of said yarns, and said pattern areas comprising an opaque coating covering the exposed surfaces of the interengaged yarns, said coating comprising an opacifying pigment providing opacity in said coating, a heat activatible free-radical initiator, and a free radical polymerized polymer binder bonding said opaque coating to the yarns.

* * * * *